United States Patent [19]

Speicher

[11] 4,396,919

[45] Aug. 2, 1983

[54] DIFFERENTIAL DRIVE PEDESTAL GIMBAL

[75] Inventor: John M. Speicher, Upland, Calif.

[73] Assignee: General Dynamics, Pomona Division, Pomona, Calif.

[21] Appl. No.: 251,402

[22] Filed: Apr. 6, 1981

[51] Int. Cl.[3] ..... H01Q 3/08

[52] U.S. Cl. ..... 343/765; 343/766; 74/1 R

[58] Field of Search ..... 343/763, 765, 766, 882; 74/1 R, 501 R, 501 M

[56] References Cited

U.S. PATENT DOCUMENTS

| | | | |
|---|---|---|---|
| 1,694,477 | 12/1928 | Long | 343/765 |
| 1,733,531 | 10/1929 | Dugan | 343/765 |
| 2,512,636 | 6/1950 | Flynt | 343/765 |
| 2,530,890 | 11/1950 | Mattke | 343/765 |
| 2,654,031 | 9/1953 | Mullins, Jr. et al. | 343/765 |
| 3,987,453 | 10/1976 | Godet | 343/765 |
| 4,014,026 | 3/1977 | Comstock | 343/766 |

FOREIGN PATENT DOCUMENTS

| | | | |
|---|---|---|---|
| 1112116 | 3/1956 | France | 343/763 |

*Primary Examiner*—Eli Lieberman

*Attorney, Agent, or Firm*—Neil F. Martin; Freling E. Baker; Edward B. Johnson

[57] ABSTRACT

A pedestal gimbal drive assembly includes a yoke and a cross shaft mounted for movement about separate orthogonal axes for affording a sensing platform for being driven by differential drive mechanism for sweeping a hemispherical segment. One embodiment of the drive means includes an endless cable drivingly connected by means of two separate reversible motors to a pair of fixed pulleys on the platform and trailed over a plurality of idler pulleys and operative to move the platform in the desired motion. An alternate embodiment includes a driven gear connected to the ring and a pair of bevelled gears connected to the driven gear and connected by link members to the two independent reversible motors.

10 Claims, 11 Drawing Figures

DIFFERENTIAL DRIVE PEDESTAL GIMBAL

BACKGROUND OF THE INVENTION

The present invention relates to mounting systems and pertains particularly to an improved gimbal drive for sensing devices such as radar antennas and the like.

Radar antennas and other similar sensing and transmitting devices are typically mounted for orientation within a hemispherical zone, for either specific directional orientation or sweeping movement. Many different gimbal mountings are known in the art and various approaches to mounting of such sensing devices have been attempted in the past. In my co-pending application, Ser. No. 970,284, filed Dec. 18, 1978 and entitled "Differential Drive Rolling Arc Gimbal", now U.S. Pat. No. 4,238,802, I disclose a type of gimbal mounting to which I apply a differential drive system. In my present application I have developed and applied the benefit of the differential drive system to a pedestal type gimbal mount.

SUMMARY AND OBJECTS OF THE INVENTION

It is the primary object of the present invention to provide an improved pedestal gimbal drive system.

In accordance with the primary aspect of the present invention a drive system for a pedestal type gimbal mounting assembly includes a pair of reversible variable speed drive motors drivingly connected by a differential drive means for driving a sensing platform about separate substantially orthogonal axes.

BRIEF DESCRIPTION OF THE DRAWINGS

The above and other objects and advantages of the present invention will become apparent from the following description when read in conjunction with the drawings, wherein.

DETAILED DESCRIPTION OF A PREFERRED EMBODIMENT

Figure 1:
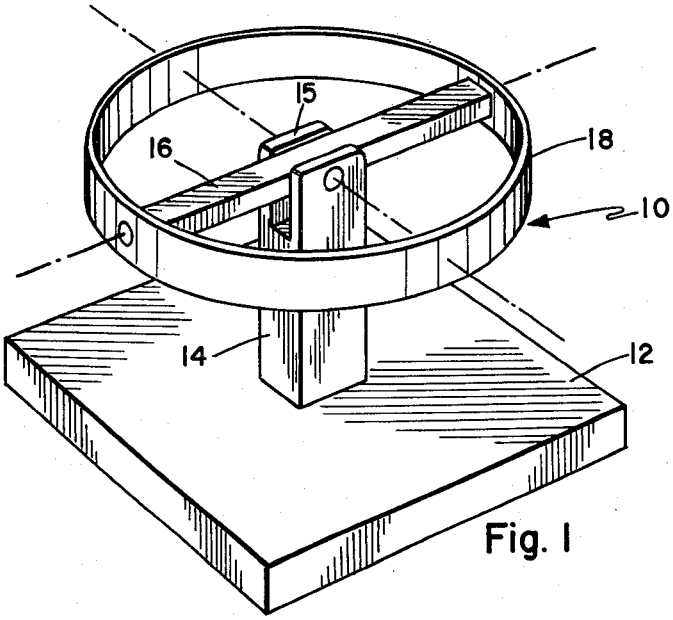
FIG. 1 is a perspective view of a basic gimbal structure.

Turning to FIG. 1 of the drawing, there is illustrated a basic pedestal gimbal with drive structure omitted, designated generally by the numeral 10 and comprising a base 12 having a post or pedestal 14 secured at one end to the base 12 and having a fork or yoke 15 at the other end. A shaft 16 is mounted for pivotal movement about a first axis corresponding to the bearings of the yoke and pivotally supporting a ring or platform mounting ring 18 for pivotal movement about a second axis corresponding to the axis of the shaft 16. This is a pedestal gimbal type structure showing a somewhat standard configuration, which normally supports a sensing platform, such as a radar antenna or the like.

Figure 2:
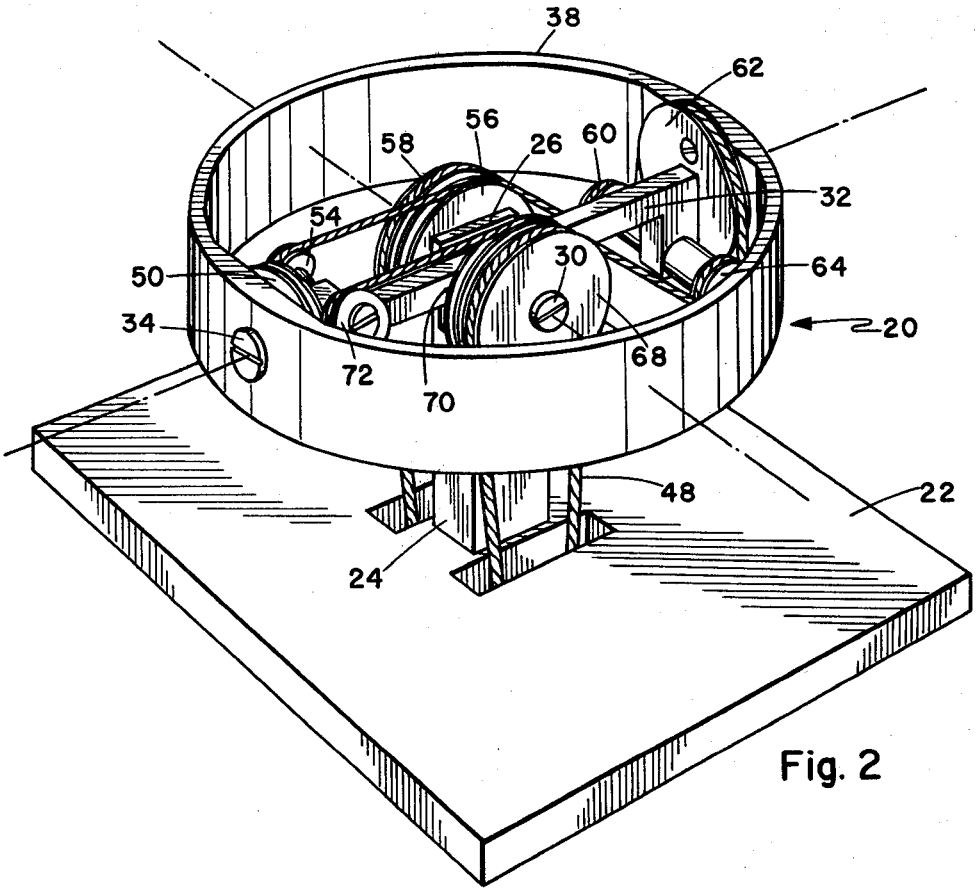
FIG. 2 is a perspective view illustrating the application of the differential drive to the gimbal structure of FIG. 1.
Figure 3:
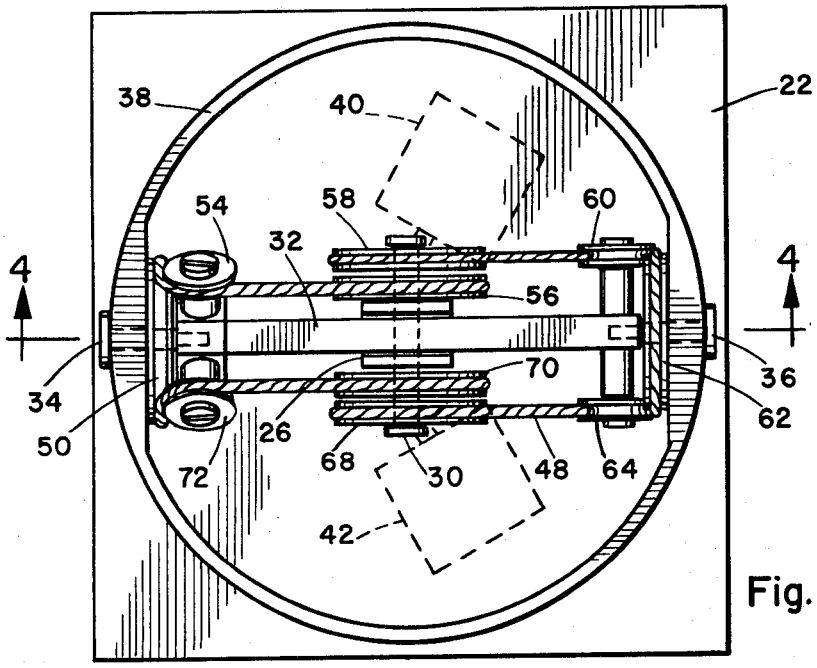
FIG. 3 is a top plan view of the structure of FIG. 2.
Figure 4:
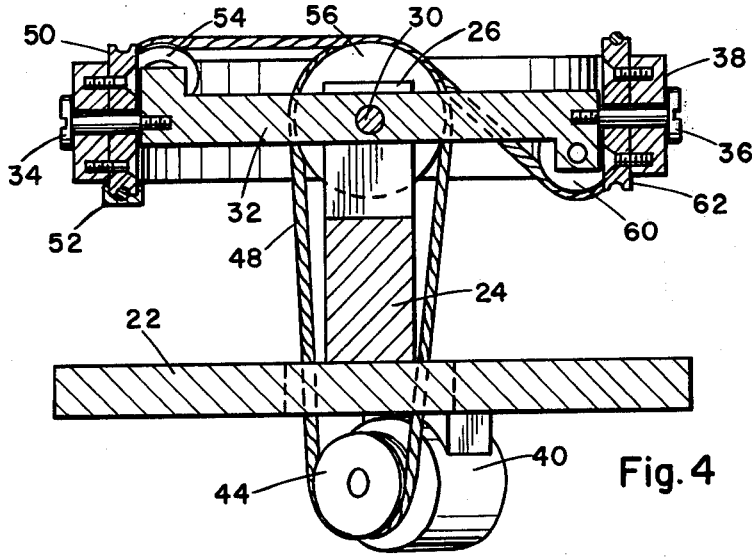
FIG. 4 is a sectional view taken on line 4—4 of FIG. 3.

Turning to FIG. 2, there is illustrated a support gimbal structure somewhat similar to the FIG. 1 embodiment having a differential drive in accordance with the invention applied thereto. A gimbal structure designated generally by the numerals 20 includes a base mounting member 22 having a post or pedestal 24 secured at one end to the base 22 and extending upward therefrom. A yoke 26 having separate spaced apart parallel legs includes bearing means for supporting a pivot shaft 30, on which is pivotally mounted a cross shaft 32. The cross shaft 32 is pivotally mounted on the support or pivot shaft 30 for pivotal motion about the axis of the shaft 30.

The cross shaft 32 includes bearing journals at 34 and 36 for pivotally supporting a platform ring 38 for pivotal movement about the cross shaft longitudinal axis. This mounting arrangement permits the platform ring 38 to pivot in substantially any one of the directions within a hemisphere.

The drive mechanism or assembly includes first and second reversible drive motors 40 and 42 having respective drive pulleys 44 and 46. These drive pulleys are connected by means of a drive cable or belt 48 to a pair of driven members or pulleys 50 and 62 which are fixed non-rotatably to the platform ring 38. While a drive cable is illustrated and described it should be understood that any suitable flexible drive member can be used such as a belt, chain, etc. Driven pulleys 50 and 62 are connected to the ring 38 and rotate therewith about the axis of the cross shaft 32. The endless belt or cable 48 may be secured to one or both of the driven pulleys 50 and 62 by a clamp or the like such as shown at 52. The cable 48 is termed an endless cable, although it may have two ends terminating at substantially the same place and connected to the pulley 50 and/or 62. The cable may not be truly endless in the technical sense, but may actually be one or two cables.

The cable, beginning at the driven pulley 50, trails over a first idler 54 adjacent the driven pulley 50, a second idler 56 journaled for rotation about pivot shaft 30, then under drive pulley 44 on motor 40 and then up over another idler pulley 58 which is mounted on shaft 30 adjacent to and concentric with idler 56. The cable then passes under idler 60, up and over driven pulley 62, the cable continuing under idler 64 and back up over idler 68, which is journaled on pivot shaft 30, down and around drive pulley 46 on motor 42 and up over idler pulley 70, adjacent and concentric with pulley 68, across idler pulley 72, and thence back to the driven pulley 50. Idler pulleys 54 and 72 are mounted above one end of cross shaft 32 and idler pulleys 60 and 64 are mounted below the other end of the cross shaft.

With this drive arrangement, the pivot of the ring 38 is established by the relative driving of the two motors 40 and 42. These motors may be driven simultaneously in the same direction or in opposite directions.

Figure 6:
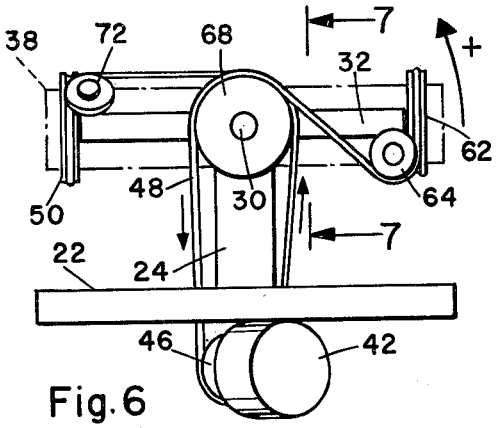
FIG. 6 is a side elevation view of the unit showing one drive cable motion.
Figure 7:
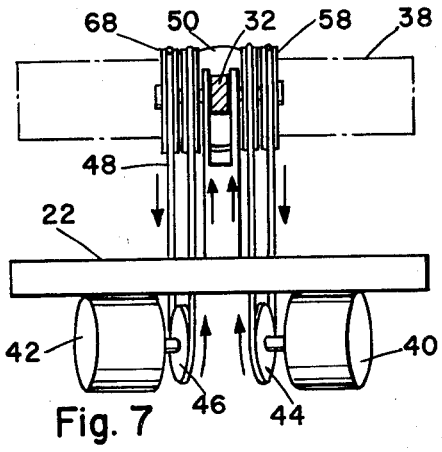
FIG. 7 is a view taken on line 7—7 of FIG. 6.

The operation of the differential gimbal drive of the invention can best be understood by describing two special cases. The first case, illustrated in FIGS. 6 and 7, is pure cross shaft motion with no motion of the sensor platform or ring 38 relative to the cross shaft 32. For this situation, both motors are driven in the same direction as shown by the arrows at the same speed. This would result in rotation of the cross shaft in a positive direction as indicated about its pivot shaft 30, with no motion of the ring 38 relative to the cross shaft 32.

Figure 8:
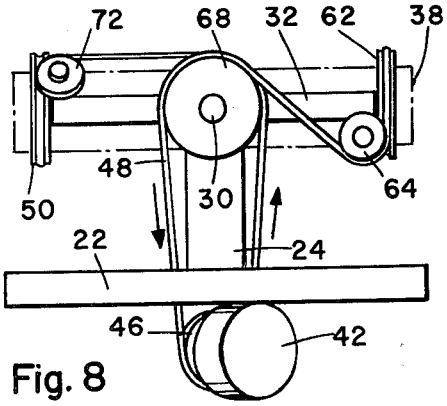
FIGS. 8 and 9 are similar to FIGS. 6 and 7, respectively, but show another drive cable motion.
Figure 9:
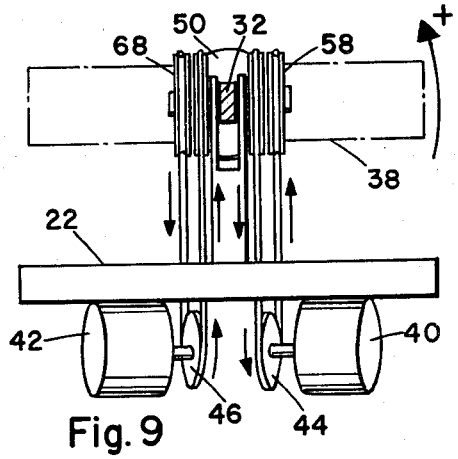

For obtaining motion of the ring 38 relative to the cross shaft 32, both motors are driven in a direction opposite one another at the same speed, as in FIGS. 8 and 9. This results in rotation of the platform or ring 38, but the cross shaft 32 remains stationary relative to the pivot shaft 30.

In order to obtain compound gimbal motion, i.e., combinations of the above described motions, a combination of the above two described cases is carried out. Compounded gimbal motion results from differential motor operation. The motors may be operated in the same direction at different speeds, or in different directions at different speeds, resulting in compound motion. The compound motion can be used simply to orient the platform in a particular direction or to sweep the sensing platform for scanning.

Figure 5:
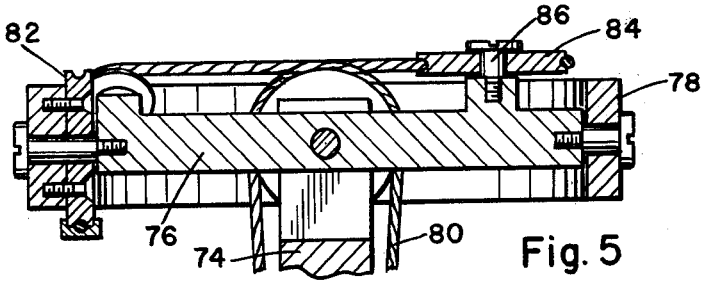
FIG. 5 is a view similar to a portion of FIG. 4, showing an alternate idler arrangement.

Turning to FIG. 5, the modification shown therein utilizes a single idler pulley 84 in place of three pulleys 60, 62 and 64 of the previously described embodiment. This embodiment includes a pedestal 74 having a yoke mounting of a cross shaft 76 with a ring 78 pivotally mounted on the axis thereof. A drive cable 80 extends around and is secured to the driven pulley 82 secured to ring 78, around idler pulleys as in the previous embodiment, and around a single idler pulley 84 mounted such as by a screw or journal member 86 on the cross shaft 76. This eliminates the two additional idler pulleys 60 and 64 and the driven pulley 62, as in the previous embodiment. The operation of the assembly is essentially the same.

Figure 10:
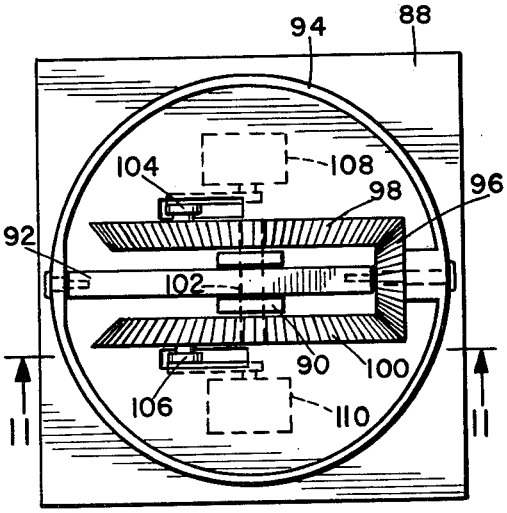
FIG. 10 is a top plan view of an alternative gear drive mechanism.
Figure 11:
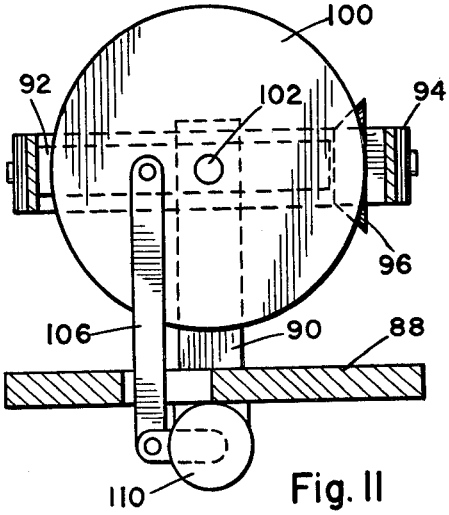
FIG. 11 is a sectional view taken on line 11—11 of FIG. 10.

Turning to FIGS. 10 and 11, a further alternate embodiment is shown wherein a platform base member 88 includes a vertically extending post 90 which includes a yoke on which is pivotally mounted a cross shaft 92 and which in turn mounts a gimbal ring or platform ring 94. A driven gear 96 of the bevel type is coupled directly to the ring 94 for rotation with the ring about the axis of the cross shaft 92. A pair of bevelled gears 98 and 100 are pivotally or rotatably mounted on the yoke shaft 102 to mesh with gear 96 and are connected by link members 104 and 106, respectively, to a pair of separate reversible drive motors 108 and 110. This arrangement requires that motors 108 and 110 need only be capable of oscillating about their axes at variable controlled rates, for respectively rotating the ring about the axes of shafts 102 or 92 or any combination thereof. I have thus provided from the above described invention a differential gimbal drive mechanism for a pedestal type gimbal mounting structure.

Thus, while I have illustrated and described my invention by means of specific embodiments, it is to be understood that numerous changes and modifications may be made in the illustrated embodiments, without departing from the spirit and scope of the invention as defined in the appended claims.

Having described my invention, I now claim:

1. A differential drive pedestal gimbal comprising:

a mounting pedestal having a mounting structure at one end and a yoke at the other;

a cross shaft pivotally mounted in said yoke for pivoting about a first axis;

a platform pivotally mounted on said cross shaft for pivoting relative to said shaft about a second axis;

drive means including a pair of variable speed reversible motors;

a drive pulley on each of said motors;

a driven pulley drivingly connected to said platform at one end of said cross shaft;

an idler pulley mounted on the other end of said cross shaft; and an elongated flexible drive cable drivingly connected to said drive pulleys and said driven pulley and extending over said idler pulley for drivingly connecting said motors for selective independent and combined rotary motion of said platform about said first and said second axes.

2. A differential drive pedestal gimbal comprising:

a mounting pedestal having a mounting structure at one end and a yoke at the other;

a cross shaft pivotally mounted in said yoke for pivoting about a first axis;

a platform pivotally mounted on said cross shaft for pivoting relative to said shaft about a second axis;

drive means including a driven pulley rotatably mounted on said cross shaft and drivingly connected to said platform;

a pair of variable speed reversible motors;

an elongated flexible cable fixed to said driven pulley drivingly connecting said motors for selective independent and combined rotary motion of said platform about said first and said second axes; and a plurality of idler pulleys support said cable between said driven pulley and said motors.

3. The differential pedestal gimbal of claim 2, wherein said plurality of idler pulleys include a plurality of pulleys mounted for rotation about said first axis.

4. The differential drive pedestal gimbal of claim 3, wherein said idler pulleys mounted about said first axis comprises first and second pairs of pulleys disposed on each side of said cross shaft and independently rotatable.

5. The differential drive pedestal gimbal of claim 4, including a pair of idler pulleys at each end of said cross shaft.

6. The differential drive pedestal gimbal of claim 1, including a driven member non-rotatably fixed to said platform at each end of said cross shaft.

7. The differential drive pedestal gimbal of claim 6, wherein said flexible cable is supported by a pair of idler pulleys at each end of said cross shaft adjacent said driven pulleys and a pair of idler pulleys at each side of said cross shaft mounted for rotation about said first axis.

8. The differential drive pedestal gimbal of claim 7 wherein the axis of said idler pulleys extend transverse to the axis of said cross shaft.

9. The differential drive pedestal gimbal of claim 1, including a pair of idler pulleys disposed at each side of said cross shaft and mounted for rotation about said first axis.

10. The differential drive pedestal gimbal of claim 9, including a pair of idler pulleys adjacent to and rotatably about an axis transverse to the driven pulley.

* * * * *